United States Patent [19]

Mazza

[11] Patent Number: 4,728,933

[45] Date of Patent: Mar. 1, 1988

[54] MINIATURE DUAL CAVITY RINGER

[75] Inventor: Frank J. Mazza, Raleigh, N.C.

[73] Assignee: U.S. Holding Company, Inc., New York, N.Y.

[21] Appl. No.: 843,438

[22] Filed: Mar. 24, 1986

[51] Int. Cl.[4] ..... G08B 3/00

[52] U.S. Cl. ..... 340/388; 340/384 R; 379/375; 381/159

[58] Field of Search ..... 340/388, 384 E, 384 R; 181/145, 160, 241; 179/84 T, 110 A, 111 E; 116/142 R; 379/375; 381/159

[56] References Cited

U.S. PATENT DOCUMENTS

| | | | |
|---|---|---|---|
| 2,514,344 | 7/1950 | Slaymaker et al. | 181/241 |
| 2,808,463 | 10/1957 | Jenkins et al. | 179/84 T |
| 2,980,888 | 4/1961 | Hothem | 340/388 X |
| 3,477,405 | 11/1969 | Jensen | 340/388 X |
| 3,517,390 | 6/1970 | Whitehead | 340/388 X |
| 3,864,532 | 2/1975 | Van Der Plaats et al. | 179/84 T |
| 4,157,459 | 6/1979 | Bush et al. | 179/84 T |
| 4,214,131 | 7/1980 | Bush et al. | 179/84 T |
| 4,234,945 | 11/1980 | Nomura et al. | 340/384 E X |
| 4,413,253 | 11/1983 | Hofer et al. | 340/388 |

FOREIGN PATENT DOCUMENTS 2062321 6/1972 Fed. Rep. of Germany .

*Primary Examiner*—James L. Rowland
*Assistant Examiner*—Brian R. Tumm
*Attorney, Agent, or Firm*—Spencer & Frank

[57] ABSTRACT

A ringer employs a low-cost miniature transducer, having a reverberant cavity, mounted in a cylindrical housing which has a second reverberant cavity in front of the miniature transducer. A very large acoustic output power is achieved when the ringer is employed in known cordless telephones, using the conventional available 3.9 volts battery. The ringer, due to its small relative size, may fit in the limited space inside a cordless telephone portable unit without costly tooling modifications. It is also suited for other uses, including for employment in compact one-piece telephones. The ringer is substantially more compact, louder in sound level, more pleasant sounding than known devices, and operates from a substantially lower DC voltage source.

16 Claims, 2 Drawing Figures

MINIATURE DUAL CAVITY RINGER

BACKGROUND OF THE INVENTION

The invention relates to a ringer which is compact and provides a ring signal from a relatively low battery voltage source.

One-piece telephones and cordless telephones require small, inexpensive ringers. One-piece telephones are known which use piezo-ceramic disk type ringers. These ringers require a high voltage to operate effectively and are relatively large in diameter. The piezo-ceramic approach requires a large area, generally 40 millimeters or greater to implement. The acoustic output power is lower than desirable, due to insufficient battery voltage available from most cordless handsets, which commonly employ 3.9 volts direct current (DC) batteries. These ringers also tend to emit a high frequency sound which is very shrill and annoying, and are very susceptible to electromagnetic interference. Cordless telephones are known which use an earpiece transducer or speaker to emit the ring signal. However, such telephones have raised concern for possible accidental hearing loss to users. The speaker approach, whether or not used in the earpiece, is costly and requires a considerable volume in both area and depth to implement. Interface drivers and expensive tooling of case parts are required.

The U.S. Food and Drug Administration has recommended reducing the sound level from the earpiece of cordless phones to such a low level that the effectiveness of the ringer is substantially diminished. A separate ringer is now needed in cordless telephones to emit both a safe and loud sound. Size and power considerations are major limitations in known designs.

SUMMARY OF THE INVENTION

The invention provides for a telephone ringer which is substantially more compact, louder in sound level, more pleasant sounding, and which operates from a substantially lower DC voltage source than known devices.

The invention employs a low-cost miniature transducer as presently supplied by several manufacturers. The small diameter makes it substantially more suitable than the larger speakers and piezo-ceramic discs. Through use of a second reverberant cavity in front of the miniature transducer, a very large acoustic output power is achieved using the available 3.9 volts battery. A ringer according to the invention, due to its small relative size, may fit in the limited space inside a cordless telephone portable unit without costly tooling modifications. However, it is also suited for other uses, including for employment in compact one-piece telephones.

The small diameter of the ringer according to the invention allows sound to exit from the parting line of the handset and therefore does not require any special tooling changes.

BRIEF DESCRIPTION OF THE DRAWINGS

The invention may be better understood from a reading of the following detailed description in conjunction with the drawings in which.

DESCRIPTION OF THE PREFERRED EMBODIMENT

Figure 1:
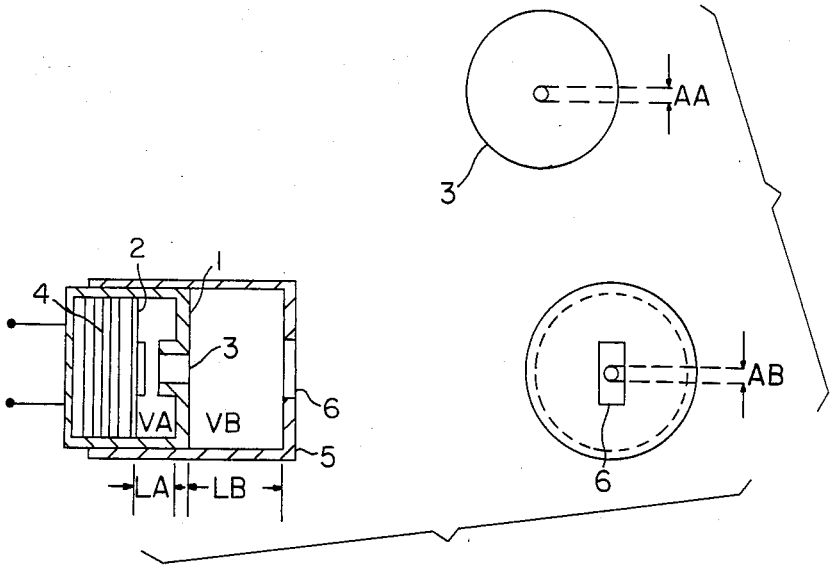
FIG. 1 shows the ringer of the invention in cross section.
Figure 2:
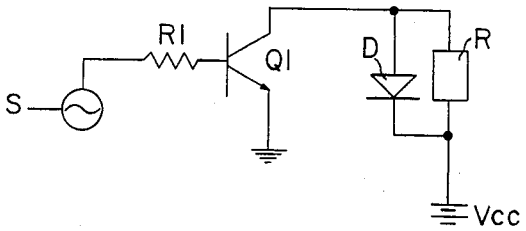
FIG. 2 shows a circuit schematic employing the ringer of the invention.

A miniature dual cavity sound ringer according to the invention is illustrated in FIG. 1 and a ringer circuit schematic is shown in FIG. 2.

As shown in FIG. 1, the ringer of the invention uses a low-cost miniature transducer 1 as presently supplied by several manufacturers (for example, the Star Micronics QMB transducer). This transducer is an electromagnetic type consisting of a 0.47 inch diameter by 0.32 inch long cylindrical housing. The housing has a 0.08 inch diameter circular sound exit port 3 in front of the diaphragm 2, between which is located transducer reverberant volume VA. Port 3 has an aperture area AA, and the cavity length of volume VA equals LA. The diaphragm 2, which has thin magnetic material secured thereto, is driven by an electromagnetic coil 4 which in turn is driven by a trnsistor from a ring signal source (not shown in FIG. 1) as seen in FIG. 2.

This small transducer does not have sufficient acoustic output at 1 kilohertz (KHZ) to 2 KHZ to serve as a ringer output. Even at 4 KHZ, which is an optimum frequency for this size transducer, the output is not sufficient at the available 3.9 volts drive (Vcc) that is typical in cordless telephone portable units.

The ringer of the invention employs a small cylindrical slip-on cavity housing 5 comprised, for example, of plastic, which adds a resonant volume VB and a rectangular sound exit port 6 which in conjunction with transducer 1 give a 9 decibel (dB) increase in acoustic output. Port 6 has an aperture area AB, and the cavity length of volume VB equals LB. Volume VB can be adjusted by sliding cavity housing 5 along the exterior of transducer 1, for example, for consumer or producer variation of sound level. Alternatively, cavity housing 5 and transducer 1 can be mated by threading the interior of cavity housing 5 and the exterior of transducer 1 for engagement thereby. Volume VB adjustment could then be accomplishing by rotation of the one relative to the other for translation.

Test measurements at 10 centimeters away show that the original transducer 1 will emit at an 87 dB sound pressure level (SPL) at 1 KHZ from a 3.9 volts peak-to-peak (VP-P) source. When the cavity housing 5 is employed with transducer 1, then the measured sound level goes to 96 dB SPL, a significant increase in sound output.

As shown in FIG. 2, a sine or square wave signal at 1 KHZ, for example, is applied from the ring signal source via current limiting resistor R1 to the base of the transistor Q1, which amplifies the signal to the point of being in the switching mode and the collector then swings from the voltage level Vcc of a D.C. voltage source to ground. This voltage on the collector is then applied across the transducer coil 4 of ringer R. The coil which is an electromagnet moves the diaphragm 2 back and forth. A protective diode D may be employed in parallel with ringer R.

A cavity length ratio LB/LA of 3 along with an aperture area ratio AB/AA of 3 yields of 9 dB increase in acoustic level. The above ratio of each parameter generates a proper reverberation in volumes VA and VB. Sound is generated by said diaphragm and is emitted in a linear manner through volume VA, circular port 3, volume VB, and finally rectangular port 6.

While the present invention has been described in connection with a preferred embodiment thereof, it is to be understood that additional embodiments, modifications, and applications which will become obvious to those skilled in the art are included within the spirit and scope of the invention as set forth by the claims appended hereto.

I claim:

1. A ringer, comprising:

a transducer, having a first reverberant cavity of volume VA and length LA; and a housing, in which said transducer is mounted, having a second reverberant cavity of volume VB and length LB between a circular sound exit port of said transducer of area AA and a rectangular sound exit port of said housing of area AB, whereby sound generated by said transducer is emitted therefrom linearly through said first reverberant cavity, said circular port, said second reverberant cavity, and said rectangular port, said transducer being translatable in said housing so as to adjust said volume VB.

2. A ringer, according to claim 1, wherein both cavity length ratio LB/LA and port area ratio AB/AA equal 3.

3. A ringer, according to claim 1, further comprising:

a ring signal source, a current limiting resistor, coupled to said ring signal source; and a transistor, connected at its base to said resistor, at its collector to said transducer, and at its emitter to a voltage reference.

4. A ringer, according to claim 3, wherein said ring signal source generates a sine wave signal.

5. A ringer, according to claim 3, wherein said ring signal source generates a square wave signal.

6. A ringer, comprising:

a sound transducer, having a first air cavity of volume VA and length LA, and a circular sound exit port of area AA, and a cylindrical housing, attached to an end of, and surrounding, said sound transducer, having a rectangular sound exit port of area AB and forming a second air cavity of volume VB and length LB in front of said first air cavity, whereby sound generated by said transducer is emitted therefrom linearly through said first air cavity, said circular port, said second air cavity, and said rectangular port, said transducer being translatable in said housing so as to adjust said volume VB.

7. A ringer, according to claim 6, wherein both cavity length ratio LB/LA and port area ratio AB/AA equal 3.

8. A ringer, according to claim 6, further comprising:

a ring signal source;

a current limiting resistor, coupled to said ring signal source; and a transistor, connected at its base to said resistor, at its collector to said sound transducer, and at its emitter to a voltage reference.

9. A ringer, according to claim 8, wherein said ring signal source generates a square wave signal.

10. A ringer, according to claim 8, wherein said ring signal source generates a sine wave signal.

11. A ringer, comprising a first cylindrical housing;

an electromagnetic coil, mounted interiorly at a first end of said first housing;

a diaphragm, mounted interiorly between said first end of said first housing and a second end of said first housing, for reverberating in response to said electromagnetic coil, wherein said first cylindrical housing has a circular sound exit port of area AA at said second end of said first housing and a first air cavity of volume VA and length LA between said diaphragm and said second end of said first housing; and a second cylindrical housing of said second housing, in which said first housing is mounted at a first end of said second housing, wherein said second housing has a rectangular sound exit port of area AB at a second end of said second housing and a second air cavity of volume VB and length LB between said rectangular port and said circular port, whereby sound generated by said diaphragm is emitted therefrom linearly through said first air cavity, said circular port, said second air cavity, and said rectangular port, said first housing being translatable in said second housing so as to adjust said volume VB.

12. A ringer, according to claim 11, wherein both cavity length ratio LB/LA and port area ratio AB/AA equal 3.

13. A ringer, according to claim 12, further comprising;

a ring signal source, a current limiting resistor, coupled to said ring signal source, a transistor, connected at its base to said resistor, at its collector to said electromagnetic coil at a first end, and at its emitter to a voltage reference, wherein said electromagnetic coil is connected at its other end to a voltage source.

14. A ringer, according to claim 13, wherein said voltage source provides a signal substantially equal to 3.9 volts direct current, and said ring signal source provides a signal substantially equal to a 1 kilohertz signal, whereby sound is emitted from said rectangular port at a sound pressure level substantially equal to 96 decibels at a distance substantially equal to 10 centimeters from said rectangular port.

15. A ringer, according to claim 13, wherein said ring signal source generates a square wave signal.

16. A ringer, according to claim 13, wherein said ring signal source generates a sine wave signal.

* * * * *